US006195955B1

(12) United States Patent
Kostopoulos

(10) Patent No.: US 6,195,955 B1
(45) Date of Patent: Mar. 6, 2001

(54) METHOD AND APPARATUS FOR CONSTRUCTING A CONCRETE BLOCK WALL

(76) Inventor: Nick Kostopoulos, 3334 Rosetta Dr., Chalmette, LA (US) 70043

( * ) Notice: Subject to any disclaimer, the term of this patent is extended or adjusted under 35 U.S.C. 154(b) by 0 days.

(21) Appl. No.: 09/272,033

(22) Filed: Mar. 18, 1999

(51) Int. Cl.[7] ..... E04B 1/00
(52) U.S. Cl. ..... 52/741.13; 52/745.09; 52/742.14; 52/740.7; 52/583.1
(58) Field of Search ..... 52/583.1, 726.1, 52/741.13, 742.14, 745.09, 740.7, 442, 439, 503

(56) References Cited

U.S. PATENT DOCUMENTS 1,213,589 * 1/1917 Collings ..... 52/726.1 X
1,959,402 * 5/1934 Anderson .
3,415,552 * 12/1968 Howlett .
4,114,344 * 9/1978 Heasman ..... 52/726.1 X
5,138,808 * 8/1992 Bengtson et al. ..... 52/295 X
5,355,647 * 10/1994 Johnson et al. ..... 52/503
5,878,544 * 3/1999 McKinnon ..... 52/439 X
5,909,980 * 6/1999 Holdsworth ..... 52/726.1 X

* cited by examiner

*Primary Examiner*—Beth A. Stephan
*Assistant Examiner*—Brian E. Glessner
(74) *Attorney, Agent, or Firm*—Garvey, Smith, Nehrbass & Doody, LLC

(57) ABSTRACT

A method of constructing a concrete block wall of concrete blocks each having one or more vertical openings includes the steps of the layering the blocks one upon the other in positions that generally align the vertical openings to initiate formation of the wall and placing a first reinforcing bar through the aligned openings, the first bar having a diameter, the lower end of the bar being anchored at a lower portion of the wall. A connector is placed on the upper end of the first bar, the connector having upper and lower end portions, a central longitudinal open ended bore and at least one reduced diameter section that extends inwardly from the interior surface of the connector wall. Additional layers of concrete blocks can then be added to the wall in positions that generally align the block openings of the added blocks with the first bar. After these additional layers of blocks have been added, a second reinforcing bar is placed through the aligned block openings of the additional layers of blocks until the second reinforcing bar is inserted into the connector. The connector tightly grips each respective bar to form a frictional engagement of the connector and the bars. The method prevents the extra work of having to lift each block above two bars in the making of the additional block layers.

14 Claims, 4 Drawing Sheets

METHOD AND APPARATUS FOR CONSTRUCTING A CONCRETE BLOCK WALL

CROSS-REFERENCE TO RELATED APPLICATIONS

Not applicable.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the construction of concrete block walls, and more particularly relates to a reinforcing bar assembly and its method of use for reinforcing concrete block walls. Even more particularly, the present invention relates to an improved connector plus reinforcing bar arrangement for joining two elongated reinforcing bars in, end-to-end orientation, wherein the assembled bars are used in a method of constructing a concrete block wall.

2. General Background of the Invention

In the construction of structures such as walls using concrete blocks, it is known in the industry to reinforce the wall by placing vertically oriented reinforcing bars through aligned vertical openings in the blocks. These vertical openings in the blocks are filled with a concrete "grout" material that surrounds the reinforcing bar.

Presently, as the wall increases in height, additional reinforcing bars must be added to the lowest reinforcing bar that is first placed through vertically aligned openings of the blocks. The present prior art practice is to couple the vertically oriented bars with wire that is wrapped several times around the respective end portions of the two connected bars, and to then continue to build the wall upwardly.

One of the problems encountered in constructing a concrete block wall in this fashion is that a bricklayer must lift each block an extra three or four feet into the air in order to place the vertical opening of the block over an upper reinforcing bar that has been connected to a lower reinforcing bar. Such is required because the bar sections are connected together when the ends of both bars are visible and accessible to the bricklayer.

Connectors for joining reinforcing rods per se are known. One example is the Howlett U.S. Pat. No. 3,415,552, entitled "Splicing Metallic Reinforcing Rods with a Threaded Coupling Sleeve".

The Bengston, et al. U.S. Pat. No. 5,138,808 uses rods in combination with a wall structure. The system includes a plurality of courses of masonry block, each block of which is formed with minimum webbing to minimize heat flow there through. The wall system is forced into a unitary structure through the utilization of post tensioning rods tied to reinforcing rods in the wall footer and extending through the voids in the respective blocks to a top plate position on the top of the wall. The rods are threaded and are post tensioned, the voids contained a polyurethane foam.

A connector for reinforcing rods is the subject of U.S. Pat. No. 1,213,589 issued to Collings. The Collings patent discloses connectors that includes circumferentially spaced, radially extending tongues stamped or cut and bent inwardly of a tube. FIGS. 5 and 7 of the Collings patent show two embodiments of a connector that is said to be useful with reinforcing rods that are used in reinforced concrete construction work, particularly reinforced concrete column construction work.

Various patented constructions relate to the joining of electrical connectors, such as for example the Toquet U.S. Pat. No. 557,037 and the Durant U.S. Pat. No. 2,235,255.

The method of connecting cables the like and articles produced thereby is the subject of the Anderson U.S. Pat. No. 1,959,402.

Other connectors in general are seen in the Bourdon U.S. Pat. No. 1,753,041, entitled "Grommet for Pneumatic Tires" and the Rockne U.S. Pat. No. 2,316,890, entitled "Welding Rod Connector".

BRIEF SUMMARY OF THE INVENTION

The present invention provides a method of constructing a concrete block wall of concrete blocks having vertical openings. The method includes the layering of a plurality of the concrete blocks one upon the other in positions that generally align the vertical openings of the blocks.

A first reinforcing bar is placed through the aligned openings of the blocks, and then placing a connector on the upper end of the first bar.

The connector includes upper and lower end portions, an open ended bore, and a plurality of smaller diameter sections that each have internal diameters smaller than the bar diameter.

Additional layers of concrete blocks are added to the wall in positions that generally align the block openings. After the additional layers of concrete blocks are added to the wall, a second reinforcing bar is placed through the aligned block openings of the additional layers of blocks that were added.

The placement of the second reinforcing bar thus occurs after several layers of blocks have been added to the wall and to an elevation well above the first reinforcing bar. The lower end portion of the second reinforcing bar is then inserted into the bore of the connector. The connector tightly grips each of the respective bars at the smaller diameter sections.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
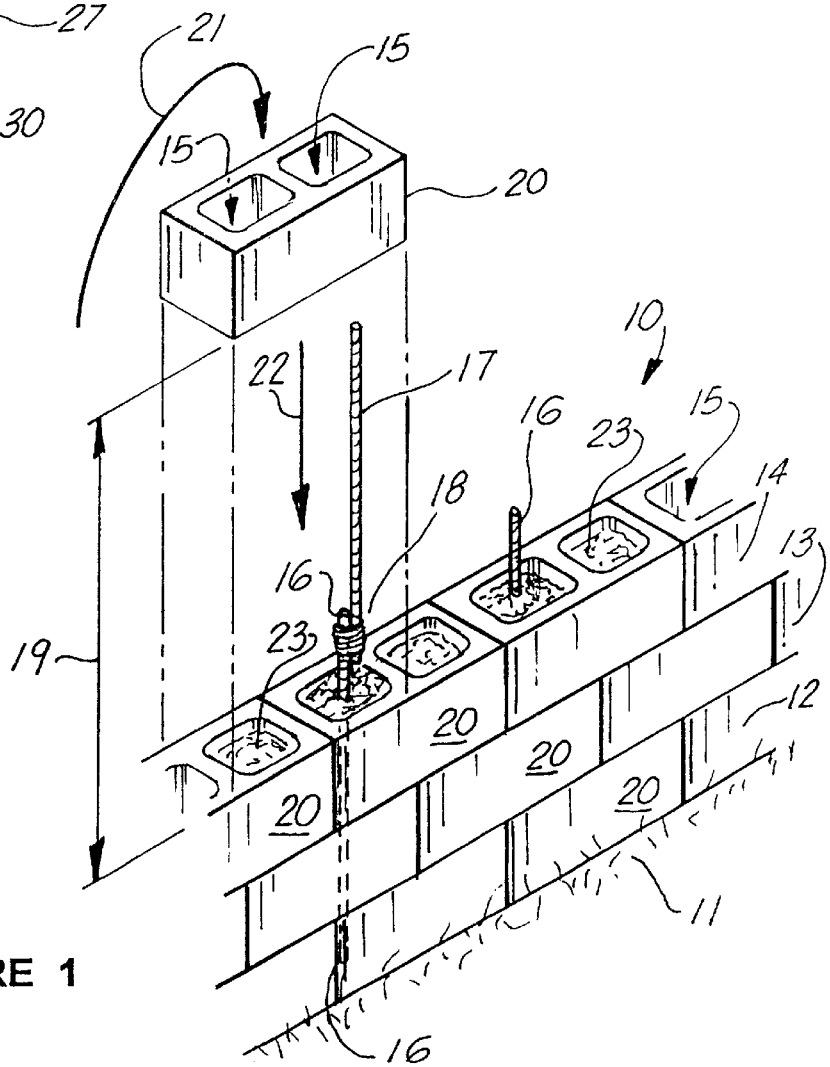
FIG. 1 is a perspective view of a prior art concrete wall installation showing two overlapping vertical reinforcing bar sections strapped together with wire.

In FIG. 1 there is shown a prior art construction of a concrete block wall designated generally by the numeral 10. In FIG. 1, the concrete block wall 10 is shown as comprising multiple layers 12–14 of concrete blocks supported by the underlying earth 11. The multiple layers 12–13 include a lower layer of concrete blocks 12, a second layer of concrete blocks 13 and a third layer of concrete blocks 14. Typically, such block walls are comprised of any number of layers 12–14 of concrete blocks (or bricks) to reach a desired elevation.

In FIG. 1, each of the concrete blocks 20 has one or more vertical openings 15. During construction of a wall, these openings 15 can be filled with concrete grout material 23. In the prior art, the openings 15 are aligned to enable the placement of reinforcing bars 16, 17 through the aligned openings. In FIG. 1, there is shown a lower reinforcing bar or "rebar" 16 and an upper reinforcing bar or "rebar" 17.

In the prior art, the reinforcing bars 16, 17 are connected together using wire 18 that is simply wrapped multiple times about the respective end portions of the reinforcing bars 16 and 17 as shown in FIG. 1. Because a user must access the top end portion of the lower bar 16, the second reinforcing or upper bar 17 must be added to the lower bar 16 before the wall 10 is too tall so that a bricklayer can wrap wire 18 around the end portions of the bars 16, 17. However, this prior art procedure creates a situation that requires the bricklayer to elevate each brick or block 20 a distance indicated by arrow 19 in FIG. 1 in order to place the opening 15 of each block 20 in communication with the top of the bar 17. This lifting of the block 20 is indicated by arrow 21. The lowering of the block 20 onto bar 17 is indicated by arrow 22.

In the building of a very large concrete block wall 10, the requirement of elevating each block 20 as shown in FIG. 1 creates unnecessary additional burden on the bricklayer that can significantly increase costs for a very large project.

Figure 5:
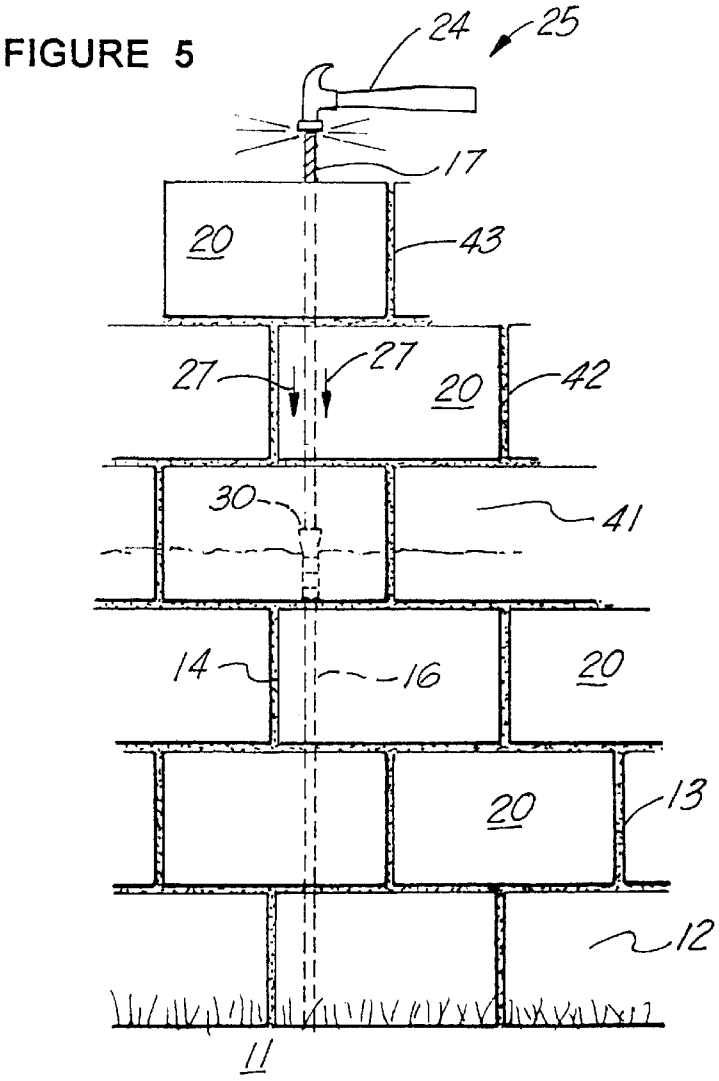
FIGS. 4 and 5 show the method of the present invention, including the steps of adding a second vertically oriented bar section to a first vertically oriented bar section, and using the connector of the present invention.
Figure 4:
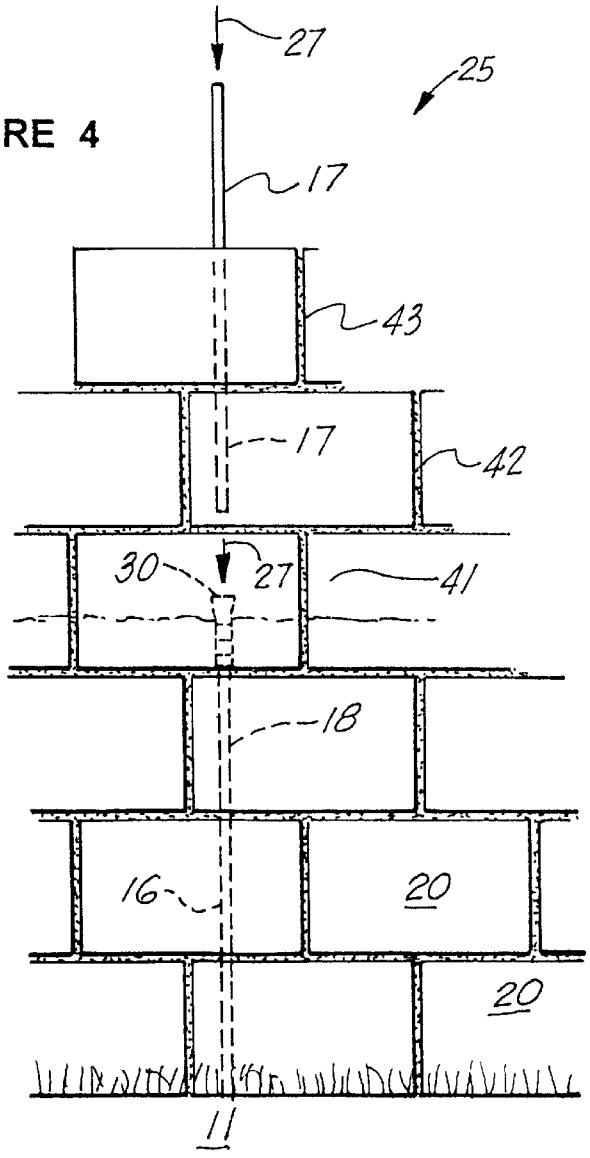

FIGS. 2–6 show an improved method for constructing a block (or brick) wall that features two reinforcing bars 16, 17 that are connected together with a connector body 30. In FIGS. 3–5 and 9, the apparatus of the present invention is designated generally by the numeral 25. Concrete block wall apparatus 25 is comprised of a plurality of layers 12–14 of concrete blocks including a lower layer 12, a second layer 13 and a third layer 14. In FIGS. 4 and 5, additional layers of concrete blocks are shown. In FIG. 4, there can be seen a connector 30 that enables a lower reinforcing bar 16 to form a connection to an upper reinforcing bar 17 using connector 30 and after three additional block layers 41, 42, 43 have been added. This is possible using the connector 30 because the connector 30 does not require hands on access by the bricklayer to the connector 30 until after additional block layers such as 41, 42, 43 have been added.

Figure 2:
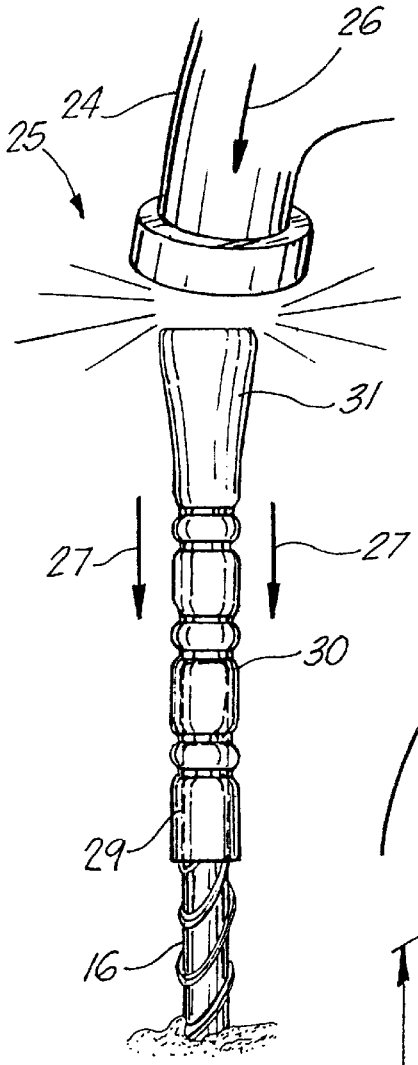
FIG. 2 is a partial perspective view of the preferred method of the present invention showing the addition of the connector portion thereof to a vertical bar section.
Figure 3:
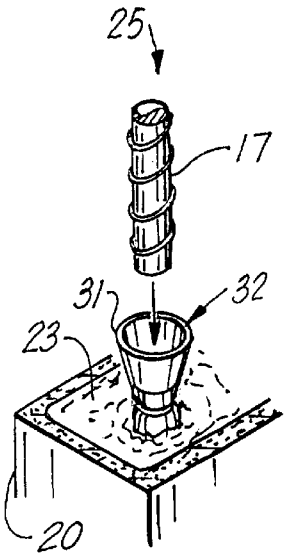
FIG. 3 is another perspective view of the method of the present invention illustrating the addition of a second bar section to the connector.

A concrete block wall is first constructed of a preliminary plurality of layers such as 12, 13, 14. A first, lower reinforcing bar 16 is then placed through the vertically aligned openings 15 of the concrete blocks 20. At this point in the method of the present invention, a second reinforcing bar 17 is not connected to the first reinforcing bar 16. Rather, only a connector body 30 is added to reinforcing bar 16 as shown in FIGS. 2, 3 and 4. A hammer 24 is used to hammer the connector body 30 to the top of lower reinforcing bar 16 as shown in FIG. 2, and as indicted by arrows 26. The connector body 30 has an upper end portion 28 and a lower end portion 29. The connector body 30 also provides a conically shaped portion 31 at its upper end 28 as shown in FIGS. 2 and 6–9. The conically shaped portion 31 communicates with open top 32 so that the lower end of reinforcing bar 17 can easily be stabbed into the open top 32 of connector body 30 when a second reinforcing bar 17 is to joined to a first, lower reinforcing bar 16.

Figure 6:
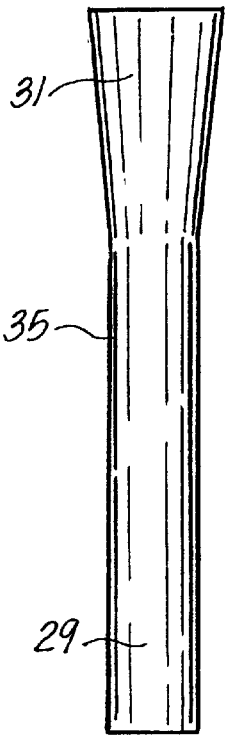
FIG. 6 is a partial perspective view of the preferred embodiment of the apparatus of the present invention illustrating the connector blank portion thereof prior to the formation of constricted portions thereon.
Figure 8:
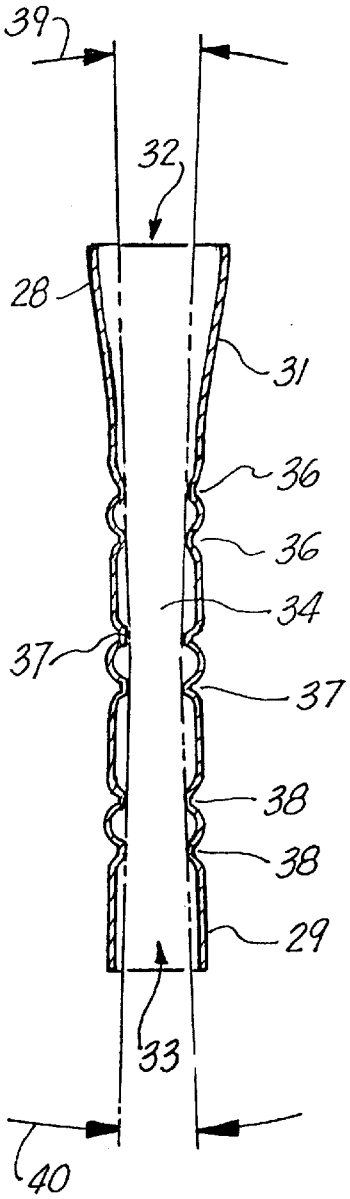
FIG. 8 is a sectional elevational view of the preferred embodiment of the apparatus of the present invention illustrating the connector portion thereof.
Figure 9:
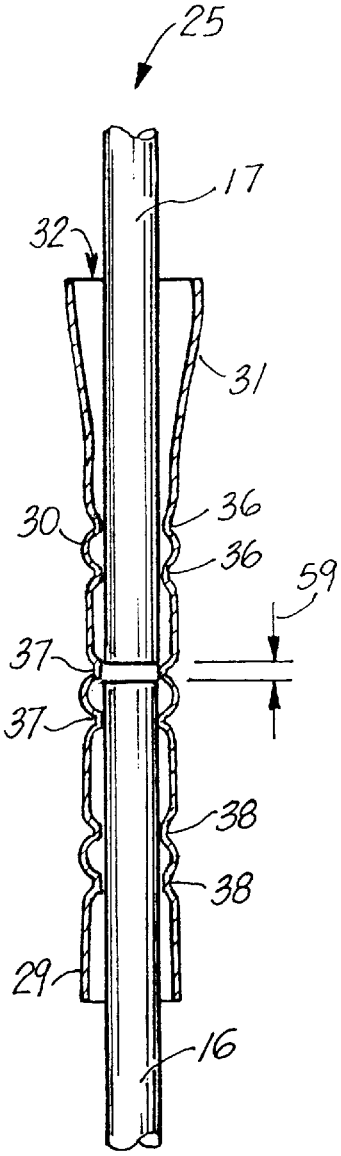
FIG. 9 is a sectional elevational view of the preferred embodiment of the apparatus of the present invention.

The connector body 30 includes an open bottom 33 for communicating with the top of lower reinforcing bar as shown in FIGS. 2 and 8–9. The connector body 30 provides a longitudinal bore 34 that communicates with open top 32 and open bottom 33. In FIG. 6, the connector body 30 is shown as a blank 35 having a cylindrically shaped lower section communicating with lower end portion 29 and the flared, conically shaped upper portion 31. In FIG. 6, the blank 35 is shown before constricted portions have been added.

Figure 7:
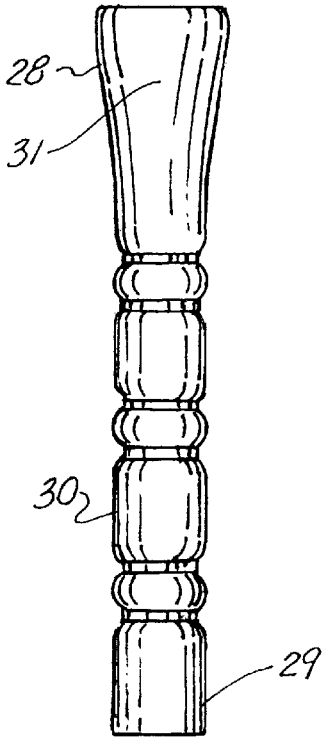
FIG. 7 is a partial perspective view of the preferred embodiment of the apparatus of the present invention.

In FIGS. 7–9, the constricted portion have been added and include an upper pair of constrictions 36, a lower pair of constrictions 38 and a middle pair of constrictions 37. These constriction 36, 37, 38 can be in the form of annular grooves. The internal diameter of the body 30 varies at each of these constrictions 36, 37, 38. Stated differently, the internal longitudinal bore 34 varies in diameter at each of the constrictions 36, 37, 38.

The constrictions 37 provide the smallest diameter for bore 34. The constrictions 36 and 38 provide a bore internal diameter that is slightly larger than the bore internal diameter at constrictions 37. In this fashion, the bar members 16, 17 will frictionally engage but pass the respective constrictions 36, 38 upon assembly of the two bar sections 16, 17 to the connector body 30. However, the smaller constricted internal diameter at constrictions 37 acts as a stop and connection that very tightly grips the end of a bar 16, 17.

The user drives the connector body 30 to the top of bar 16 until the upper end of lower bar 16 engages one of the constrictions 37 (see FIG. 9). One of the constrictions 36 stops further penetration of the bar 16 into bore 34 of connector body 30. The connector body 30 is installed on the top of bar 16 when the block wall 25 reaches an elevation next to the top of bar 16. In FIGS. 4 and 5, the connector body 30 is added to lower reinforcing bar 16 after the first three layers 12, 13, 14 of blocks have been added to the wall 25. In FIG. 3, the block 20 shown is a block that is in the third layer 14 of wall 25.

Arrows 39 and 40 in FIG. 8 demonstrate that both the top and bottom portions of the body 30 can be flared so that attaching an upper bar 17 to the connector 30 is easily facilitated. After the first reinforcing bar 16 and the connector body 30 have been added, additional layers such as fourth layer 41, fifth layer 42 and sixth layer 43 can be added to the wall 25. These layers 41–43 are added without interference by a second, vertically extended reinforcing bar 17. The user does not have to lift each block 20 a distance 19 in order to thread the block 20 over an already connected bar 17. Rather, the reinforcing bar 17 is added after the first bar 16 is in place and additional layers 41, 42, 43 have been added to the wall.

FIGS. 3–5 and 9 demonstrate the addition of an upper reinforcing bar 17 to the assembly of lower reinforcing bar 16 and connector body 30. In FIGS. 3 and 4, the user threads the upper reinforcing bar 17 through vertically aligned openings 15 of blocks 20 that form a part of layers 41, 42, 43 of wall 25. The lower end of upper reinforcing bar 17 registers with the conically shaped portion 21 of connector body 30. As indicated by arrows 27 in FIGS. 2, 4 and 5, the upper bar 17 is placed into the conically shaped portion 31 and open top 32 of connector body 30. The user then uses hammer 24 to drive upper reinforcing bar 17 into connector body 30 until the lower end of upper reinforcing bar 17 reaches the middle constrictions 37 of connector body 30 as shown in FIG. 9. A very small gap in FIG. 9 that is indicated by the numeral 59 shows the distance between the reinforcing bars 16, 17 when connection of bars 16, 17 to body 30 is complete.

Figure 11:
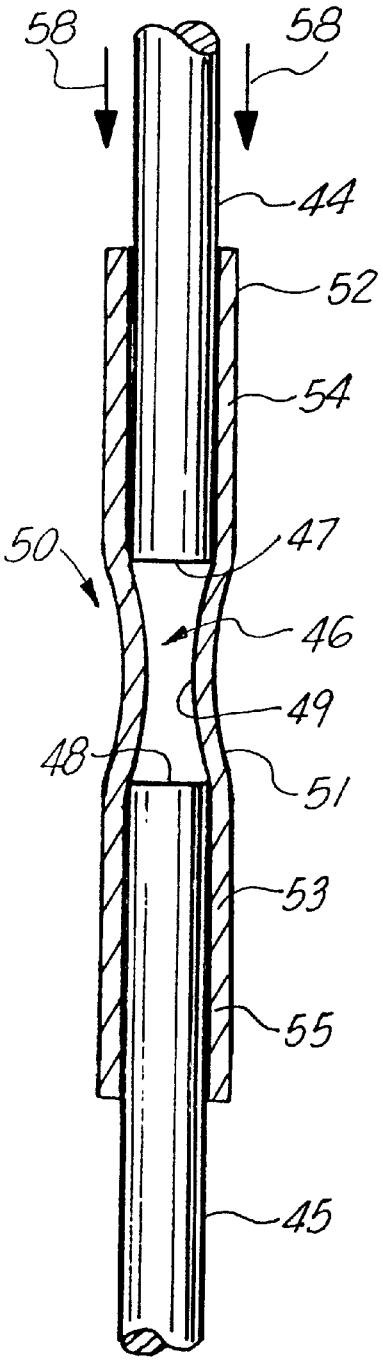
FIG. 11 is a sectional elevational view of a second embodiment of the apparatus of the present invention.
Figure 10:
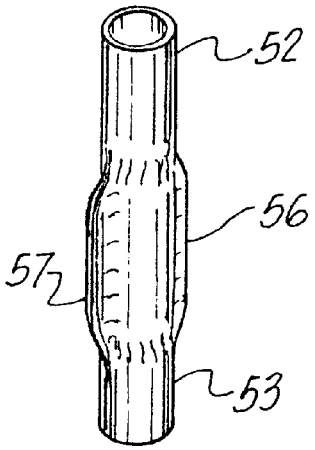
FIG. 10 is a partial perspective view of a second embodiment of the apparatus of the present invention showing an alternate construction of the connector portion.
Figure 12:
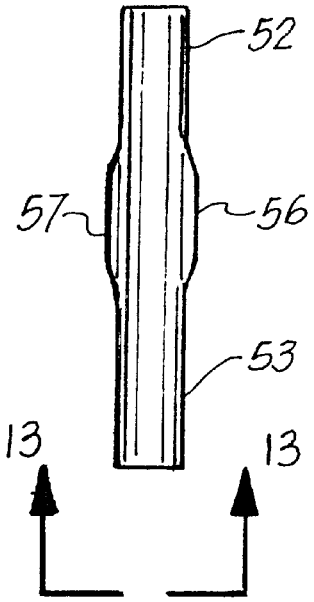
FIG. 12 is fragmentary elevational view of the second embodiment of the apparatus of the present invention showing the connector portion thereof.
Figure 13:
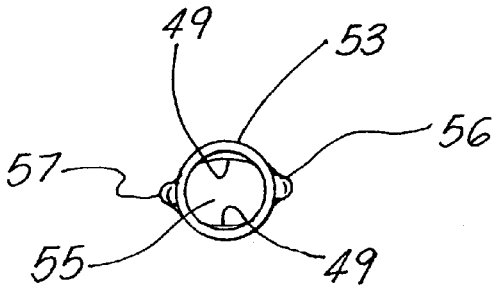
FIG. 13 is a sectional view taken along lines 13—13 of FIG. 12.

FIGS. 10–13 show an alternate construction of the apparatus of the present invention designated generally by the numeral 50 in FIG. 11. Rebar connection apparatus 50 is shown in use with an upper rebar 44 and a lower rebar 45. A constricted space 46 is defined by crimped portions 56, 57. The lower end 47 of upper reinforcing bar 44 is shown engaging the constriction space 46 of connector body 51.

A pair of cylindrically shaped wall sections 52, 53 provide respective cylindrical bores 54, 55 that conform to the ends of the reinforcing bars 44, 45 as shown in FIG. 11. Arrow 58 in FIG. 11 demonstrates the downward movement of upper bar 44 when the two bar sections 44, 45 are to be added to the connector body 51.

The alternate apparatus 50 of FIG. 11 could be used to construct a wall 25 as with the preferred embodiment of FIGS. 2–9. The lower reinforcing bar 45 would be added to the brick wall after, for example, three layers 12–14 of concrete blocks have been added. The connector body 51 is then placed at the upper end 48 of lower bar section 45. Additional layers such as fourth, fifth and sixth layers 41–43 are then added to the block wall 25. The user then threads the upper reinforcing bar 44 through the aligned openings of fourth, fifth and sixth block layers 41–43 before applying a second reinforcing bar 44 in the same fashion as was done in the preferred embodiment of FIGS. 4 and 5.

The following table lists the parts numbers and parts descriptions as used herein and in the drawings attached hereto.

PARTS LIST

| Part Number | Description |
|---|---|
| 10 | concrete block wall |
| 11 | earth |
| 12 | lower layer |
| 13 | second layer |
| 14 | third layer |

-continued

PARTS LIST

| Part Number | Description |
|---|---|
| 15 | opening |
| 16 | lower reinforcing bar |
| 17 | upper reinforcing bar |
| 18 | wire |
| 19 | arrow |
| 20 | concrete block |
| 21 | arrow |
| 22 | arrow |
| 23 | grout |
| 24 | hammer |
| 25 | concrete block wall apparatus |
| 26 | arrow |
| 27 | arrow |
| 28 | upper reinforcing bar |
| 29 | lower reinforcing bar |
| 30 | connector body |
| 31 | conically shaped portion |
| 32 | open top |
| 33 | open bottom |
| 34 | longitudinal bore |
| 35 | blank |
| 36 | construction |
| 37 | construction |
| 38 | construction |
| 39 | arrow |
| 40 | arrow |
| 41 | fourth layer |
| 42 | fifth layer |
| 43 | sixth layer |
| 44 | upper rebar |
| 45 | lower rebar |
| 46 | constricted space |
| 47 | end |
| 48 | end |
| 49 | inside surface |
| 50 | rebar connector apparatus |
| 51 | connector body |
| 52 | cylindrical wall section |
| 53 | cylindrical wall section |
| 54 | cylindrical bore |
| 55 | cylindrical bore |
| 56 | crimped portion |
| 57 | crimped portion |
| 58 | arrow |
| 59 | gap |

The foregoing embodiments are presented by way of example only; the scope of the present invention is to be limited only by the following claims.

What is claimed is:

1. A method of constructing a concrete block wall of concrete blocks having vertical openings, comprising the steps of:

a) layering a plurality of said blocks one upon the other in positions that generally align the vertical openings;

b) placing a first reinforcing bar through the aligned openings, the first bar having a diameter;

c) placing a connector on the upper end of the first bar, said connector having upper and lower end portions, the upper end portion having an enlarged diameter section with an open top, an open ended bore, and a crimped position that provides multiple smaller diameter sections that each have an internal diameter smaller than the bar diameter;

d) adding additional layers of concrete blocks to the wall in positions that generally align the block openings;

e) placing a second reinforcing bar through the aligned block openings of said additional layers of blocks that were added in step "d";

f) inserting the lower end portion of the second bar into the open top and bore of the connector;

g) wherein in steps "c" and "f" the connector tightly grips each respective bar at the smaller diameter sections of the connector.

2. The method of claim 1 wherein the bars are metallic.

3. The method of claim 1 further comprising the step of inserting the second bar into a flared, conically shaped portion of the connector.

4. The method of claim 1 wherein in step "c" the connector has annular grooves defining said smaller diameter sections and further comprising engaging the connector at an annular groove in steps "f" and "g".

5. The method of claim 1 wherein the connector has multiple and small diameter portions and further comprising the step of frictionally engaging an end of each bar with the connector.

6. The method of claim 1 wherein each smaller diameter portion is defined by crimped portions of the connector.

7. The method of claim 1 wherein step "g" the connector grips each bar at multiple positions spaced along the length of the bar.

8. The method of claim 7 wherein the crimped sections are annular grooves.

9. The method of claim 7 wherein the crimped sections are longitudinally extended crimped spaced circumferentially apart.

10. A method of constructing a concrete block wall of concrete blocks that each have one or more vertical openings, comprising the steps of:

a) layering a plurality of said blocks one upon the other in positions that generally align the vertical openings to initiate formation of the wall;

b) placing a first reinforcing bar through the aligned openings, the first bar having a diameter, the lower end portion of said bar being anchored at a lower end portion of the wall;

c) placing a connector on the upper end of the first bar, said connector having upper and lower end portions, an open ended bore, and at least one reduced diameter section that has an internal diameter smaller than the bar, the upper end portion having an enlarged diameter section with an open top that communicates with the bore;

d) adding additional layers of concrete blocks to the wall in positions that generally align the block openings of the added blocks with the first bar;

e) placing a second reinforcing bar through the aligned block openings of said additional layers of blocks that were added in step "d";

f) inserting the lower end portion of the second bar into the open top and bore of the connector;

g) wherein in steps "c" and "f" the connector tightly grips each respective bar at crimped sections of the connector.

11. The method of claim 10 further comprising the step of inserting the second bar into a flared, conically shaped portion of the connector.

12. The method of claim 10 wherein in step "c" the connector has annular grooves defining said smaller diameter sections and further comprising engaging the connector at an annular groove in steps "f" and "g".

13. The method of claim 10 wherein the crimped sections are annular grooves.

14. The method of claim 10 wherein the crimped sections are longitudinally extended crimps spaced circumferentially apart.

* * * * *